US011604008B2

(12) United States Patent
Griesinger et al.

(10) Patent No.: US 11,604,008 B2
(45) Date of Patent: Mar. 14, 2023

(54) BASE SYSTEM FOR AIR HANDLER

(71) Applicant: Air Distribution Technologies IP, LLC, Milwaukee, WI (US)

(72) Inventors: Scott A. Griesinger, Cameron, MO (US); Paul D. Studer, McFall, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 225 days.

(21) Appl. No.: 17/162,795

(22) Filed: Jan. 29, 2021

(65) Prior Publication Data

US 2021/0239358 A1 Aug. 5, 2021

Related U.S. Application Data

(60) Provisional application No. 62/968,428, filed on Jan. 31, 2020.

(51) Int. Cl.
*F24F 13/32* (2006.01)
*F24F 13/20* (2006.01)

(52) U.S. Cl.
CPC ..... *F24F 13/32* (2013.01); *F24F 13/20* (2013.01); *F24F 2221/16* (2013.01)

(58) Field of Classification Search
CPC ..... F24F 13/32; F24F 13/20; F24F 2221/16
See application file for complete search history.

(56) References Cited

U.S. PATENT DOCUMENTS

| | | | | | |
|---|---|---|---|---|---|
| 4,303,289 | A * | 12/1981 | Hardy | F16B 12/50 | 403/231 |
| 4,887,399 | A * | 12/1989 | Berger | F24F 13/32 | 52/27 |
| 5,870,868 | A * | 2/1999 | Kita | E04C 2/384 | 403/231 |
| 9,217,581 | B1 * | 12/2015 | Merideth | F24F 13/32 | |
| 2009/0056248 | A1 | 3/2009 | Pflum et al. | | |
| 2013/0087677 | A1 * | 4/2013 | Pooler | F24F 13/32 | 248/575 |
| 2020/0370782 | A1 * | 11/2020 | Tamboli | F24F 13/32 | |

* cited by examiner

*Primary Examiner* — Emmanuel E Duke
(74) *Attorney, Agent, or Firm* — Fletcher Yoder, P.C.

(57) ABSTRACT

A base system for a heating, ventilation, and air conditioning (HVAC) system includes a frame configured to support a housing of the HVAC system, where the frame includes a base rail configured to define a portion of a perimeter of the frame. The base rail includes a base segment configured to be disposed on a curb in an installed configuration of the HVAC system, an external wall extending from the base segment, a top segment extending from the external wall, an internal wall extending from the top segment, and a recessed flange extending from the internal wall and away from the external wall.

20 Claims, 7 Drawing Sheets

BASE SYSTEM FOR AIR HANDLER

CROSS REFERENCE TO RELATED APPLICATIONS

This application claims priority from and the benefit of U.S. Provisional Application Ser. No. 62/968,428, entitled "BASE SYSTEM FOR AIR HANDLER," filed Jan. 31, 2020, which is hereby incorporated by reference in its entirety for all purposes.

BACKGROUND

This section is intended to introduce the reader to various aspects of art that may be related to various aspects of the present disclosure, and are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. An HVAC system may control the environmental properties through control of an air flow delivered to the environment. For example, the HVAC system may place the air flow in a heat exchange relationship with a refrigerant to condition the air flow. In some cases, a portion of the HVAC system, such as an air handling unit, may be coupled to a curb of a structure to enable the HVAC system to utilize ambient air as a portion of the air flow, to exhaust return air into an ambient environment, and/or to supply conditioned air to a conditioned space within the structure.

An HVAC system, such as an air handler, configured to be positioned on a curb of a structure may include a large housing that contains HVAC equipment, such as fans, blowers, filters, sound attenuation components, and/or heat transfer devices (e.g., heat exchangers, coils, furnaces, adiabatic coolers, etc.). The housing may have several structural components, such as a base foundation, frame members, beams, wall panels, floor panels, and so forth, that are coupled to one another to provide a rigid structure within which the HVAC equipment is disposed. Unfortunately, manufacturing of HVAC system housings may be complicated. Additionally, existing housing designs may provide limited rigidity and may be susceptible to thermal inefficiencies.

SUMMARY

In an embodiment, a base system for a heating, ventilation, and air conditioning (HVAC) system includes a frame configured to support a housing of the HVAC system, where the frame includes a base rail configured to define a portion of a perimeter of the frame. The base rail includes a base segment having a base rail face configured to abut a curb in an installed configuration of the HVAC system, an external wall extending transversely from the base segment, a top segment extending transversely from the external wall and over the base segment, an internal wall extending transversely from the top segment toward the base segment, and a recessed flange extending from the internal wall and away from the external wall.

In another embodiment, an enclosure for a heating, ventilation, and air conditioning (HVAC) system includes a frame having a plurality of base rails defining a perimeter of the enclosure, where a base rail of the plurality of base rails includes a base segment configured to be disposed on a curb in an installed configuration of the enclosure, an external wall extending from the base segment, a top segment extending from the external wall and toward an interior of the enclosure, an internal wall extending from the top segment toward the base segment, and a recessed flange extending from the internal wall toward the interior of the enclosure. The enclosure also includes a floor panel captured between the plurality of base rails, where the floor panel is disposed on and secured to the recessed flange of the base rail.

In a further embodiment, a heating, ventilation, and air conditioning (HVAC) system housing includes a plurality of base rails coupled to one another to define a base frame of the HVAC system housing. A base rail of the plurality of base rails includes a base segment configured to be disposed on a curb in an installed configuration of the HVAC system housing, an external wall extending vertically from the base segment, a top segment extending horizontally from the external wall and over the base segment, an internal wall extending vertically from the top segment toward the base segment, and a recessed flange extending horizontally from the internal wall and away from the external wall.

DRAWINGS

DETAILED DESCRIPTION

Figure 1:
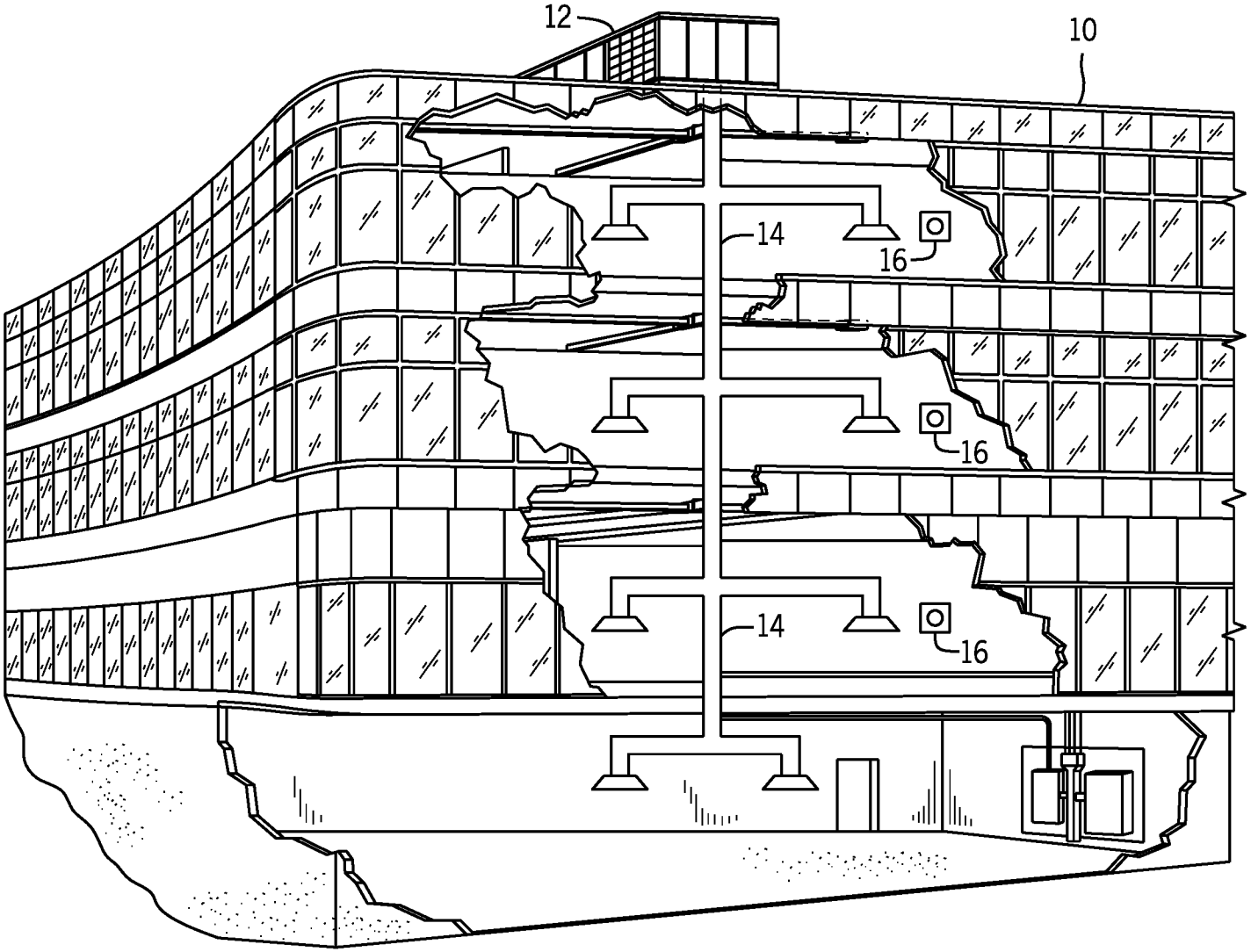
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to heating, ventilation, and/or air conditioning (HVAC) systems, and, more particularly, to a base system for an HVAC system configured to be disposed on and/or coupled to a curb of a structure or building to enable fluid communication between components of the HVAC system with ductwork of the structure that delivers conditioned air to various locations within the structure. For example, the HVAC system may be an indoor or outdoor air handling unit coupled to openings of the ductwork, such that the HVAC system may direct conditioned air toward or into the structure and/or receive return air from the structure. In general, an air handling unit includes a housing that contains HVAC equipment, such as fans, blowers, filters, sound attenuation components, and/or heat transfer devices (e.g., heat exchangers, coils, furnaces, adiabatic coolers, etc.), configured to enable the circulation, conditioning, and/or supply of an air flow to or from a conditioned space. The housing may include a base or foundation configured support additional elements of the housing (e.g., walls), as well as components (e.g., HVAC equipment) disposed within the housing. As will be appreciated, the base of the housing should be structurally rigid to provide support for other components of the air handling unit and to withstand deformation, such as during transportation or other re-location of the air handling unit. Unfortunately, manufacturing air handling units having adequate structural rigidity may be costly, time-intensive, and/or procedurally complicated.

Accordingly, embodiments of the present disclosure are directed to a base system for a housing of an air handling unit or other HVAC system that provides desired structural rigidity for the air handling unit and that may be manufactured and/or assembled more efficiently (e.g., faster, at reduced cost, etc.). Base system configurations disclosed herein may also have reduced height dimensions (e.g., vertical dimensions) and/or reduced weights, as compared to traditional air handling unit bases or foundations. Further, the embodiments disclosed herein enable improvements in operational efficiency of the air handling unit, such as by providing improved thermal breaks or barriers between an interior of the air handling unit and an environment surrounding the air handling unit. For example, the base system of the air handling unit includes one or more base channels or rails having a geometry with an increased moment of inertia that provides improved rigidity and/or stiffness of the base system. These and additional features of the base system are described in further detail below.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system or may be another type of HVAC system, such as an air handling unit.

The HVAC unit 12 may be an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It should be appreciated that any of the features described herein may be incorporated with the HVAC unit 12 or other HVAC systems, such as air handling units. Additionally, while the features disclosed herein are described in the context of embodiments that directly condition and/or circulate a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

An HVAC system, such as the HVAC unit 12 or an air handling unit, may be positioned on a curb of a structure. As used herein, a "curb" may refer to an interface between ductwork of the structure and the HVAC system. The curb may include openings extending through a wall, roof, ceiling, floor, or other portion of the structure. For example, the openings may enable fluid communication between the ductwork and the HVAC system and/or an ambient environment external to the structure. In some embodiments, the curb may include a first opening that is fluidly coupled to a first terminal end of a supply air duct within the structure and a second opening that is fluidly coupled to a second terminal end of a return air duct within the structure. The first opening may receive supply air, or conditioned air, from the HVAC system, and the supply air may ultimately be returned to the HVAC system, via the second opening, as return air. However, in other embodiments, the HVAC system may have other configurations to receive and discharge air flows.

Figure 2:
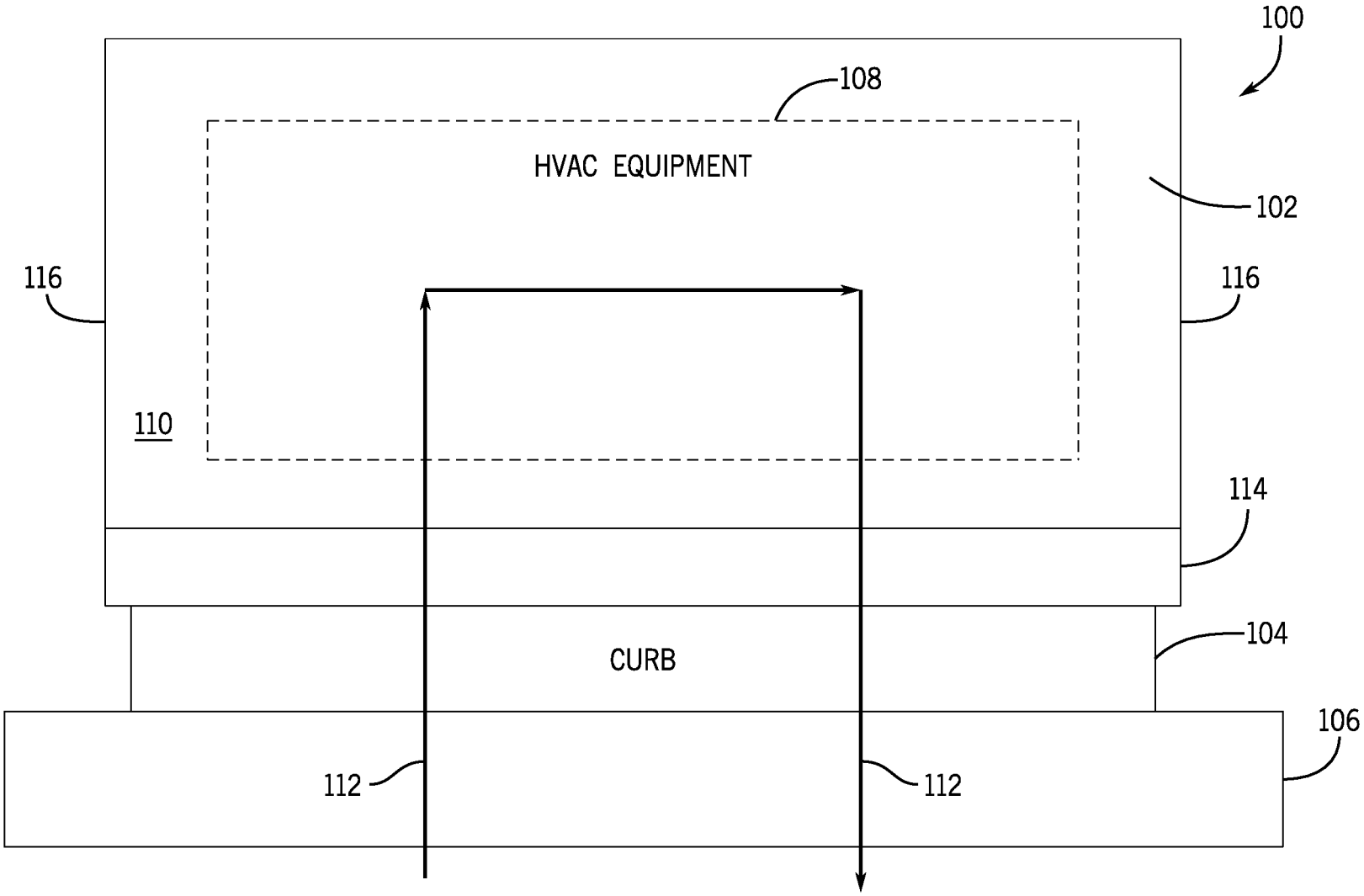
FIG. 2 is a schematic of an embodiment of an HVAC system having a base system positioned on a curb of a structure, in accordance with an aspect of the present disclosure.

As mentioned above, the HVAC system may include a housing configured to contain components of the HVAC system that are configured to condition, circulate, and/or otherwise control air flow directed through the HVAC system. For example, FIG. 2 is a schematic of an air handling unit 100 (e.g., an HVAC system) having a housing 102 (e.g., enclosure) positioned on a curb 104 of a structure 106. In some embodiments, the curb 104 may be located on a roof of a building, and the air handling unit 100 may be an outdoor unit. However, the air handling unit 100 may be an indoor unit in other embodiments. The housing 102 contains HVAC equipment 108 disposed within an internal volume 110 of the housing 102. The HVAC equipment 108 may include one or more heat exchangers, coils, furnaces, electric heaters, fans, blowers, filters, and/or sound attenuation devices configured to enable conditioning and/or circulation of air flow directed through the air handling unit 100. In the illustrated embodiment, an air flow 112 is directed from the structure 106, through the curb 104 and into the housing 102 (e.g., into the internal volume 110) to be conditioned and/or circulated by the HVAC equipment 108. Thereafter, the air flow 112 may be discharged from the housing 102 and directed back into the structure 106 via the curb 104. However, it should be appreciated that other embodiments of the air handling unit 102 may have other configurations and may be designed to intake and/or discharge additional or alternative air flows (e.g., return air flow, outdoor air flow, exhaust air flow, supply air flow, etc.).

The housing 102 includes a base system 114 positioned on the curb 104. In other words, the housing 102 engages with the curb 104 via the base system 114. The base system 114 is configured to support additional components of the housing 102 (e.g., wall panels 116 of the housing 102), as well as components disposed within the housing 102, including the HVAC equipment 108. The base system 114 may be an assembly formed by multiple components, such as channels, rails, panels, pans, plates, etc. that are coupled to one another. As discussed in detail below, the base system 114 includes components, features, and/or configurations that provide improved structural rigidity for the housing 102 and the air handling unit 100. The improved structural rigidity enables more efficient manufacture and assembly of the air handling unit 100 and also increases resistance of deformation in the air handling unit 100 during transportation or other re-location of the air handling unit 100.

Figure 3:
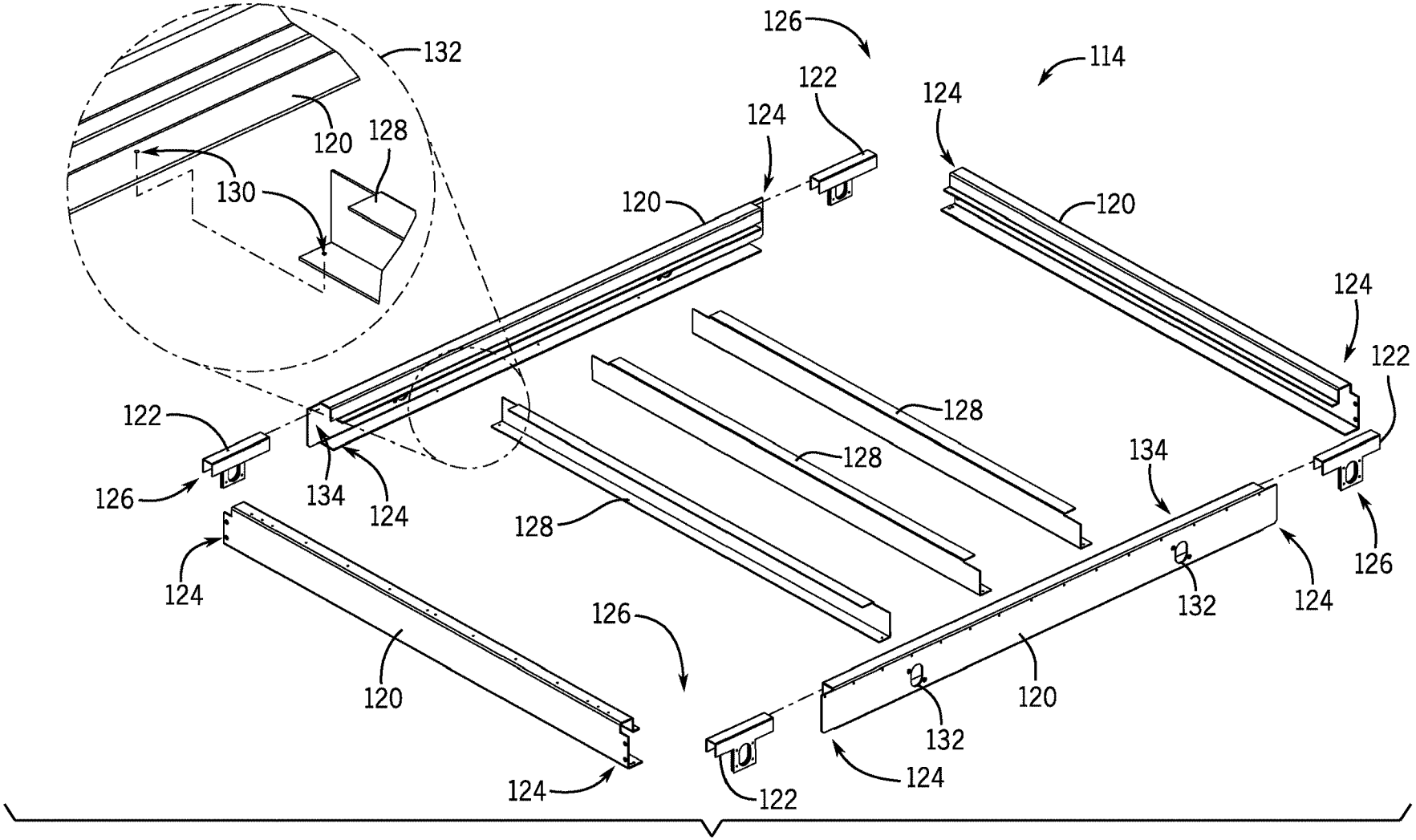
FIG. 3 is an exploded perspective view of an embodiment of a base system for an HVAC system, in accordance with an aspect of the present disclosure.

FIG. 3 is an exploded perspective view of an embodiment of the base system 114, which may be incorporated with the air handling unit 100 or other HVAC system. The base system 114 is configured to support a weight of the housing 102 and the components contained therein. In some implementations, the base system 114 may also engage with the curb 104 in an installed configuration of the air handing unit 100. In the illustrated embodiment, the base system 114 includes a plurality of base rails 120 (e.g., base channels, perimeter base channels, etc.) that are configured to couple to one another to form a frame of the base system 114. For example, the base rails 120 may be secured to one another via a metallic bonding process, such as welding or brazing, and/or may be coupled via mechanical fasteners. In some embodiments, the base system 114 may include filler plates 122 configured to extend between adjacent or adjoining base rails 120 to facilitate alignment and/or securement of the base rails 120 to one another. One or more distal ends 124 of the base rails 120 may mitered to facilitate alignment and coupling of the base rails 120 at corners 126 of the base system 114. It should be appreciated that the geometry and features of the base rails 120 described herein may enable self-alignment (e.g., self-squaring) of the base rails 120 to form a frame of the base system 114, thereby improving assembly and manufacturing of the air handling unit 100.

The base system 114 also includes interior cross rails 128 that extend between and couple to base rails 120 disposed opposite one another. For example, the interior cross rails 128 may be welded, brazed, or otherwise mechanically secured to the base rails 120. Thus, the interior cross rails 128 provide structural connection between base rails 120 that are not directly coupled to one another. The base system 114 may include any suitable number of interior cross rails 128. For example, the number of interior cross rails 128 may be selected based on a size of the air handling unit 100, equipment (e.g., HVAC equipment 108) to be contained within the housing 102, and/or other variables. As described in further detail below, the base rails 120 and the interior cross rails 128 may cooperatively support floor panels, isolator rails, equipment installed within the housing 102, and/or other components of the air handling unit 100.

As mentioned above, the base rails 120 disclosed herein include a geometry that provides increased stiffness (e.g., increased moment of inertia) compared to traditional rails or beams (e.g., standardized structural members) typically utilized to form a base of an HVAC unit. Thus, the base system 114 has improved structural rigidity compared to existing systems. The geometry of the base rails 120 is described in detail below. The base rails 120 having the geometry or configuration described herein may be formed from steel (e.g., 3/16" steel, plate steel, structural steel, etc.), another metal, or other suitable material. In some embodiments, the base rails 120 may be formed via a forming or roll-forming process. Thus, the base rails 120 may be manufactured more precisely and more consistently as compared to traditional standardized structural members. It should be noted that the interior cross rails 128 may be formed from similar materials and with a similar manufacturing process as the base rails 120.

Furthermore, as the base rails 120 and interior cross rails 128 may be formed with a material having a reduced thickness (e.g., 3/16" steel), the base rails 120 and interior cross rails 128 may be readily modified to include additional features that facilitate more efficient assembly, manufacturing, and/or transportation of the base system 114 and/or air handling unit 100. For example, as shown in the illustrated embodiment, the base rails 120 and/or the interior cross rails 128 may include holes 130 (e.g., punched holes), which may be formed via a punching process. The holes 130 may be utilized as alignment features to facilitate more efficient assembly of the base system 114, as shown in inset 132 of FIG. 2. In some embodiments, holes 130 may be formed in one or more of the base rails 120 and/or the interior cross rails 128 to enable securement of other features of the air handling unit 100 (e.g., wall panels 116) to the rails 120 and 128.

Other features may also be readily formed in the base rails 120 and/or the interior cross rails 128, such as via a punching process. For example, one or more of the base rails 120 may include lifting holes 132 (e.g., lifting points, ISO lifting container points, etc.) formed therein that enable use of standardized lifting devices to lift and move the air handling unit 100. Therefore, lifting lugs or other components that typically extend outward from a base may not be incorporated with the air handling unit 100. In this way, a footprint of the air handling unit 100 may be reduced, and transportation of the air handling unit 100 may be improved. The number of lifting holes 132 may also be increased compared to the number of lifting lugs included with existing HVAC units, which may further facilitate or improve the transportation or relocation of the air handing unit 100. In some embodiments, the base rails 120 may be reinforced at the lifting holes 132, such as via backing plates positioned about the lifting holes 132 on an interior-facing surface 134 of the base rail 120.

Figure 4:
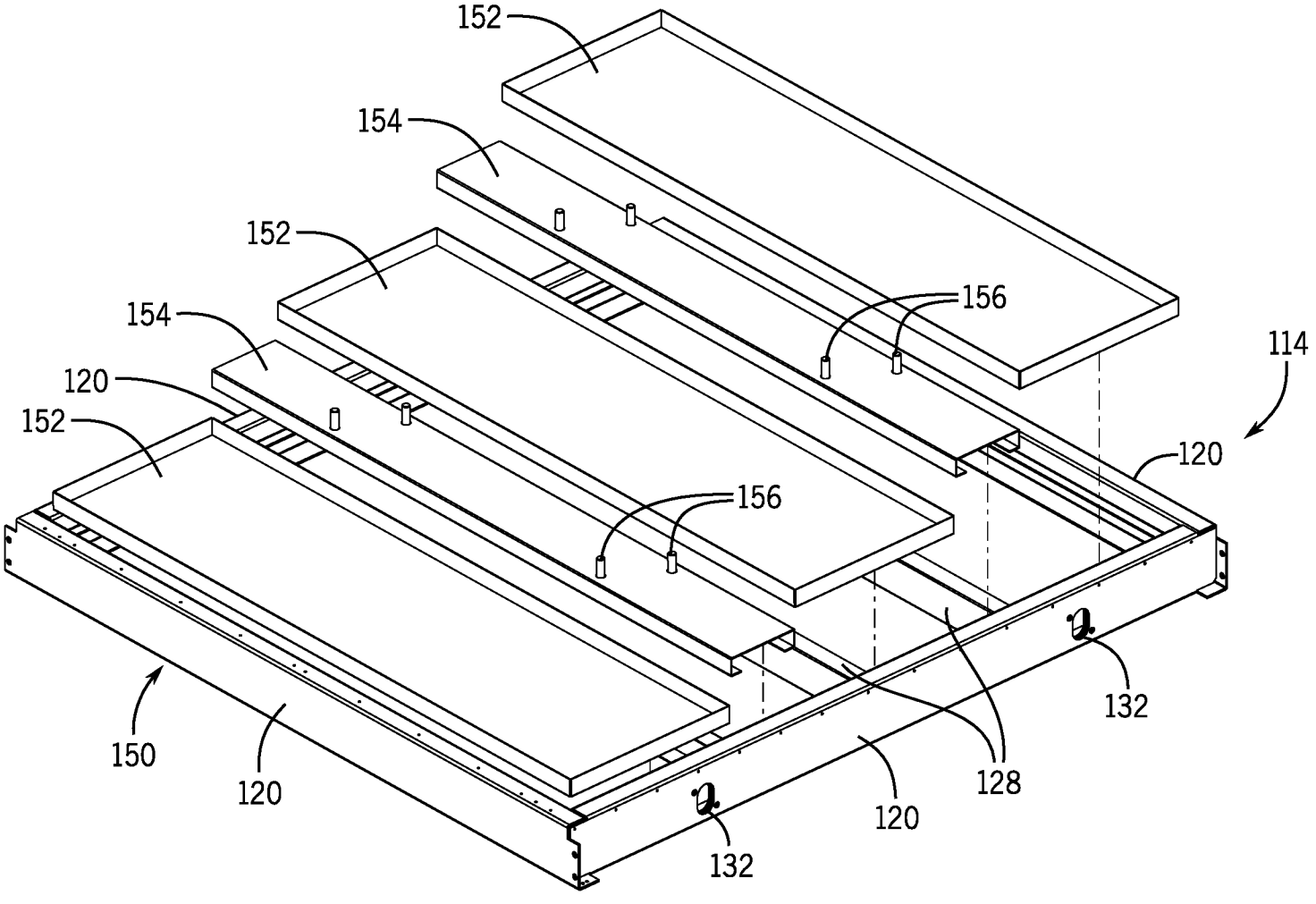
FIG. 4 is an exploded perspective view of an embodiment of a base system for an HVAC system, in accordance with an aspect of the present disclosure.

FIG. 4 is a perspective view of an embodiment of the base system 114, illustrating the base rails 120 and the interior cross rails 128 in an assembled configuration to form a frame 150 (e.g., perimetric frame) of the base system 114 and/or air handling unit 100. The illustrated embodiment also includes floor panels 152 (e.g., floor pans) and isolator rails 154 configured to be supported by and secured to the frame 150. That is, the floor panels 152 and the isolator rails 154 are secured to one or more of the base rails 120 and the interior cross rails 128. The floor panels 152 and the isolator rails 154 may be secured to the base rails 120 and the interior cross rails 128 via an adhesive, which may facilitate efficient assembly of the base system 114 and reduced manufacturing costs. Additionally or alternatively, a welding or brazing process may be utilized to secure the floor panels 152 and the isolator rails 154 to the frame 150. In some embodiments, the floor panels 152 and the isolator rails 154 may also be secured to one another, such as via an adhesive, a bonding process, mechanical fasteners, or other suitable technique.

The floor panels 152 and the isolator rails 154 may be formed from the same or similar material as the base rails 120 and the interior cross rails 128. For example, the floor panels 152 and the isolator rails 154 may be formed from steel or other metal. The floor panels 152 and the isolator rails 154 may have the same or different thicknesses of material. In some embodiments, the isolator rails 154 may be formed from a thicker material than the floor panels 152 in order to enable support of components (e.g., HVAC equipment 108) mounted or secured to the isolator rails 154. As shown, the isolator rails 154 may also include additional features, such as mounting lugs 156 (e.g., mounting points) to enable mounting of components to the isolator rails 154.

Figure 5:
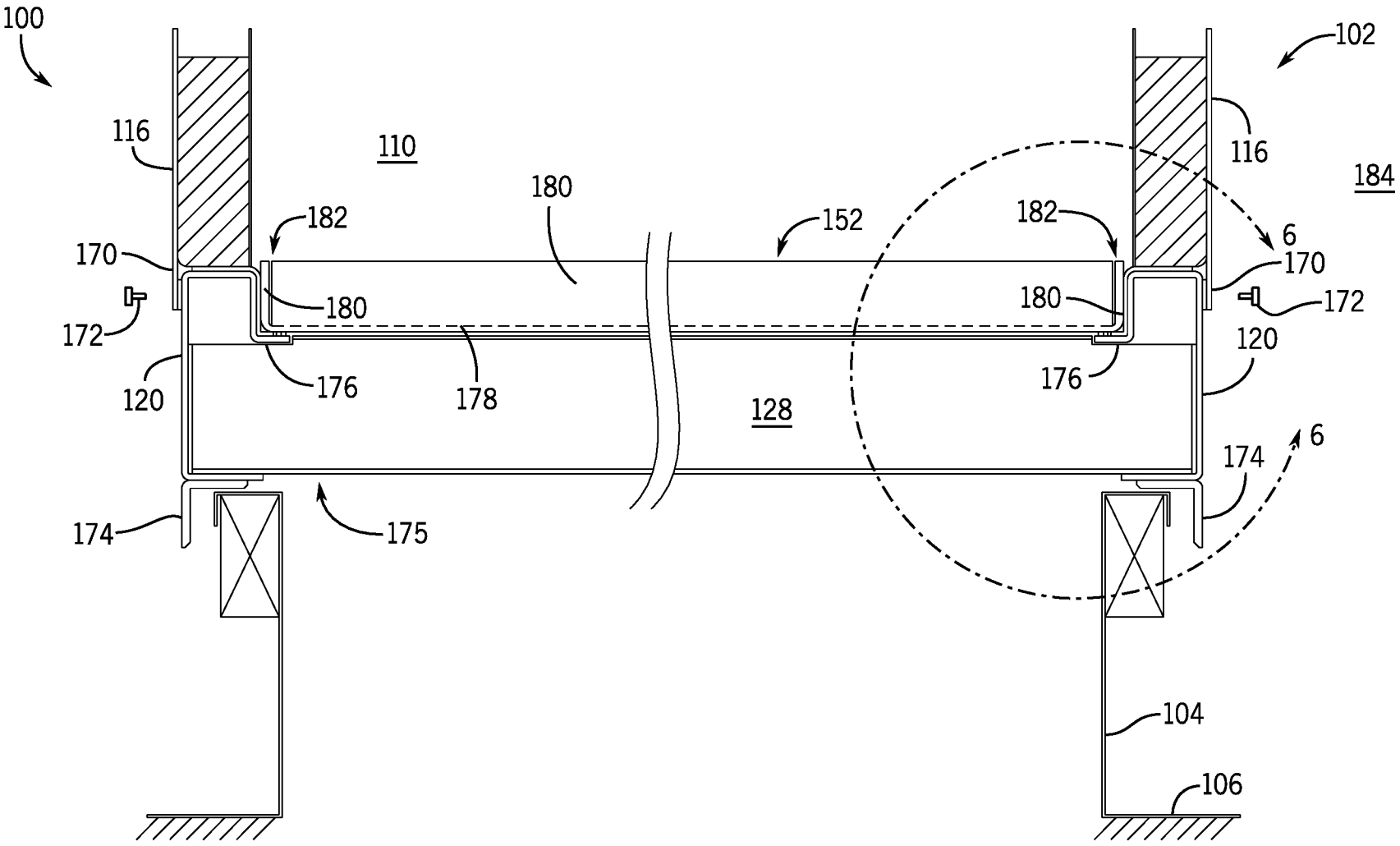
FIG. 5 is a partial cross-sectional side view of an embodiment of a housing of an HVAC system positioned on a curb of a structure, illustrating a base system of the housing, in accordance with an aspect of the present disclosure.

FIG. 5 is a partial cross-sectional side view of an embodiment of the air handling unit 100 positioned on the curb 104. The illustrated embodiment shows the base system 114 in an assembled configuration, as well as additional components of the housing 102 assembled with the base system 114. For example, wall panels 116, which extend from the base system 114 and at least partially define the internal volume 110 of the air handling unit 100, are secured to the base rails 120. The wall panels 116 may be secured to the base rails 120 using any suitable technique, such as a bonding process, adhesive, and/or mechanical fasteners. In some embodiments, holes (e.g., holes 130) may be punched or otherwise formed in the base rails 120 and/or in the wall panels 116, such as a mounting flange 170 of the wall panel 116, and a mechanical fastener 172 may extend through the wall panel 116 and the base rail 120 to secure the wall panel 116 to the base system 114.

The air handling unit 100 may also include a curb adapter 174 (e.g., curb angle, curb rest, etc.) positioned on an underside 175 of the base system 114 (e.g., a base rail face of the base rail 120). The curb adapter 174 may facilitate alignment of the air handling unit 100 with the curb 104 during installation of the air handling unit 100. In some embodiments, one or more gaskets may be positioned between the curb adapter 174 and the curb 104 to provide a seal between the air handling unit 100 and the curb 104. In some embodiments, the underside 175 of the base system 114 additionally or alternatively abuts the curb 104 in an installed configuration of the air handling unit 100.

In the assembled configuration, the floor panel 152 is captured between opposing base rails 120 of the base system 114. Each base rail 120 includes a recessed flange 176 (e.g., internal flange) upon which the floor panel 152 is positioned, such that the base rails 120 are disposed laterally outward or external to the floor panel 152 (e.g., relative to the internal volume 110). More specifically, the floor panel 152 includes a base portion 178 positioned on the recessed flange 176 and an upturned lip 180 (e.g., flange, extension, etc.) that extends from an edge of the base portion 178 and that also engages with the base rail 120, as described below with reference to FIG. 6. In some embodiments, the floor panel 152 may be formed from a single piece of material. For example, one or more upturned lips 180 may be formed, such as via a bending process. The upturned lips 180 may be welded to one another at edges 182 of the upturned lips 180 to create a sealed pan with the floor panel 152. Each upturned lip 180 may engage with one of the base rails 120 or interior cross rails 128 in an assembled configuration of the air handling unit 100. This configuration of the floor panel 152 may also increase the stiffness of the floor panel 152, which improves the overall structural rigidity and integrity of the base system 114 and the air handling unit 100.

In the configuration described herein, the floor panel 152 is internal to the base rails 120 (e.g., fully within the housing 102) and is not exposed to an external environment 184 surrounding the air handling unit 100. For example, the floor panel 152 does not extend laterally outward (e.g., relative to the internal volume 110) between the base rails 120 and the wall panels 116 as provided in existing air handling unit designs. The arrangement of the base rails 120 and floor panels 152 described herein reduces or eliminates a direct conduction path (e.g., heat conduction path) between the internal volume 110 and the external environment 184 and thus provides a thermal break (e.g., thermal break joint) therebetween. Thus, conditioned air within the air handling unit 100 is further insulated from the external environment 184, which improved efficient operation of the air handling unit 100.

The floor panel 152 may be secured to the base rails 120 and/or to the interior cross rails 128 via an adhesive (e.g., a structural adhesive). Thus, the floor panel 152 may be installed in the base system 114 without mechanical fasteners and without a welding or brazing process, which reduces time and costs associated with assembly of the air handling unit 100. However, in some embodiments, welding or other bonding process may utilized to secure at least a portion of the floor panel 152 to the frame 150 (e.g., at certain intermediate rails or seams). Moreover, use of an adhesive to secure the floor panel 152 to the frame 150 (e.g., the base rails 120 and/or to the interior cross rails 128) also provides an improved barrier (e.g., thermal barrier) between the floor panel 152 and the frame 150, which reduces thermal conduction therebetween.

Figure 6:
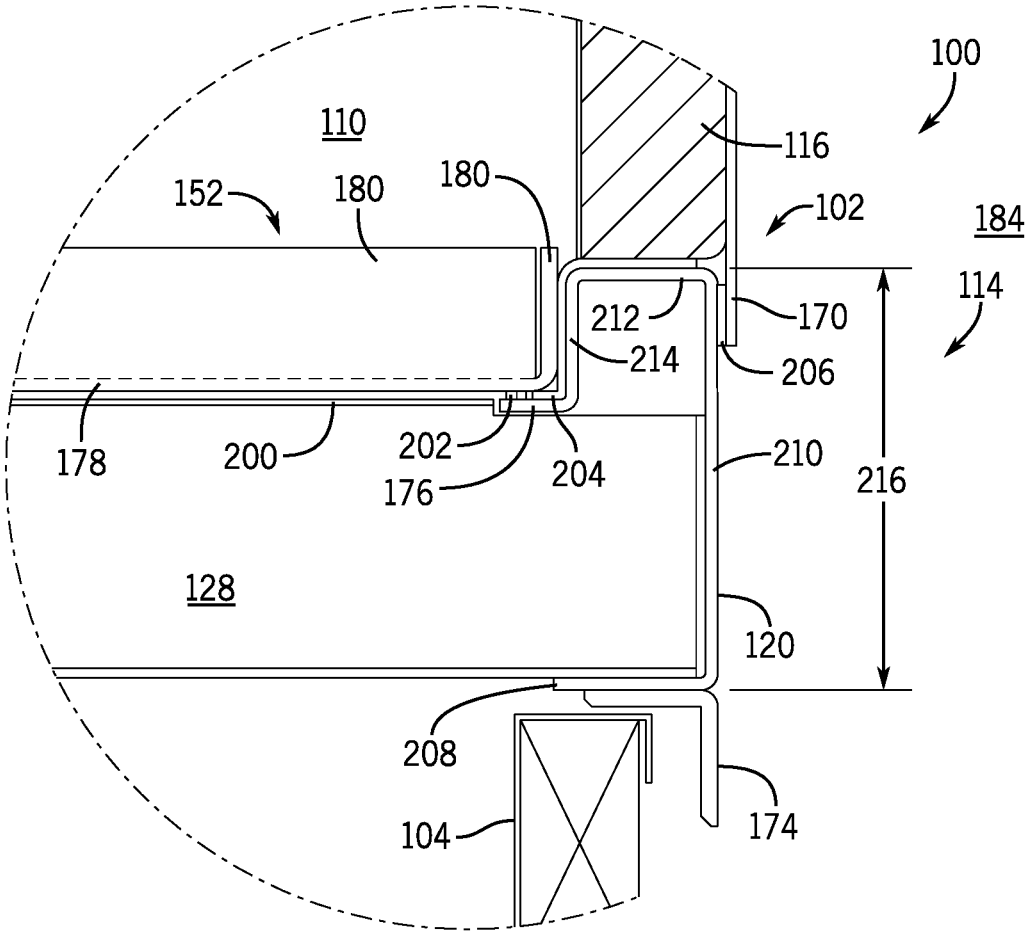
FIG. 6 is an expanded cross-sectional side view of an embodiment of a housing of an HVAC system positioned on a curb of a structure, illustrating a base system of the housing, in accordance with an aspect of the present disclosure.

FIG. 6 is an expanded cross-sectional side view, taken within line 6-6 of FIG. 5, of the air handling unit 100 positioned on the curb 104, illustrating the base system 114 and air handling unit 100 in an assembled and installed configuration. As discussed above, the floor panel 152 is positioned on and between opposing base rails 120 of the frame 150. In particular, the base portion 178 of the floor panel 152 is positioned on recessed flanges 176 of the base rails 120. It should be noted that, in some embodiments, the floor panel 152 may also be also positioned on a surface 200 (e.g., a top flange) of one or more of the interior cross rails 128. Additionally, the upturned lips 180 of the floor panel 152 may also abut and/or engage with the base rails 120. The floor panel 152 may be secured to the base rails 120 via an adhesive 202 (e.g., a structural adhesive). For example, the adhesive 202 may be deposited on the recessed flanges 176, and the floor panel 152 may be positioned on the recessed flanges 176 to adhere to the recessed flanges 176 via the adhesive 202. As will be appreciated, utilization of the adhesive 202 may reduce or eliminate the use of welding, brazing, screws, or other mechanical fasteners traditionally employed to assemble HVAC unit base components. Utilization of the adhesive 202 instead of a welding process to assemble the base system 114 also enables use of different materials to form the base rails 120 and the floor panel 152. Thus, present embodiments of the base system 114 and air handling unit 100 may be manufactured and assembled more quickly and at a reduced cost.

As discussed above, the present techniques also provide a thermal break between the internal volume 110 of the air handling unit 100 and the external environment 184 surrounding the air handling unit 100, for example, by incorporating the floor panel 152 that does not extend between the base rail 120 and the wall panel 116. The thermal break may be further improved via incorporation of gaskets, seals, or other insulating elements with the base system 114. In the illustrated embodiment, the base system 114 includes a gasket 204 positioned between the floor panel 152 and the base rail 120 in an assembled configuration of the base system 114. For example, the gasket 204 may be made from a foam, a polymer, or other suitable material. The gasket 204 extends between the floor panel 152 and the base rail 120 along the base portion 178 and the upturned lip 180 of the floor panel 152. The gasket 204 further extends between the base rail 120 and the wall panel 116. While the gasket 204 extending between the floor panel 152, the base rail 120, and the wall panel 116 in the illustrated embodiment is a continuous gasket, other embodiments of the air handling unit 100 may incorporate multiple, separate gaskets 204 or other sealing or insulation elements positioned between components of the base system 114. For example, a gasket 206 is also positioned between the base rail 120 and the mounting flange 170 of the wall panel 116.

As mentioned above, the base rail 120 has a geometry and/or configuration that provides improved structural rigidity for the base system 114, the housing 102, and the air handling unit 100. Specifically, in addition to the recessed flange 176, the base rail 120 includes a base portion 208, an external wall 210, a top portion 212, and an internal wall 214 in an arrangement that has an increased moment of inertia. The base portion 208 may be a base segment (e.g., first segment, horizontal segment, base wall, etc.) that is coupled to the curb adapter 174 and is positioned on the curb 104 in an installed configuration of the air handling unit 100. Additionally, interior cross rails 128 of the base system 114 may be disposed on and coupled to the base portion 208 in an assembled configuration of the frame 150. The external wall 210 may be a second segment (e.g., vertical segment, vertical wall, etc.) that extends from the base portion 208 and is exposed to the external environment 184 in the installed configuration of the air handling unit 100. The top portion 212 may be a third segment (e.g., top segment, horizontal segment, top wall, etc.) that extends from the external wall 210. As shown, the base portion 208, the external wall 210, and the top portion 212 form a generally C-shaped configuration. Thus, the base portion 208 and the top portion 212 may extend generally parallel with one another (e.g., in horizontal directions). In an assembled configuration of the air handling unit 100, the wall panel 116 is positioned on the top portion 212 of the base rail 120. Thus, the top portion 212 of the base rail 120 defines an uppermost surface or segment of the base rail 120 in the assembled configuration. The internal wall 214 may be a fourth segment (e.g., vertical segment, vertical wall, etc.) that extends from the top portion 212 and faces the internal volume 110 of the air handling unit 100. That is, the internal wall 214 faces an interior of the base system 114, as compared to the external wall 210, which faces an exterior of the base system 114. The internal wall 214 extends from the top portion 212 towards the base portion 208, and the internal wall 214 may extend generally parallel to the external wall 210 (e.g., in a vertical direction). Further, the recessed flange 176 extends (e.g., extends horizontally) from the internal wall 214 towards the internal volume 110 of the air handling unit 100 (e.g., in a direction opposite the external wall). The base rail 120 having the base portion 208, the external wall 210, the top portion 212, the internal wall 214, and the recessed flange 176 in the illustrated configuration may be formed, such as via forming, bending, or roll-forming, from a single piece of material (e.g., 3/16" structural steel). This configuration of the base rail 120 may be formed with improved precision and repeatability and also at a reduced cost.

As will be appreciated by those of ordinary skill in the art, the disclosed configuration of the base rail 120 provides an increase in the moment of inertia, and thus the stiffness, of the base rail 120. In particular, the stiffness and structural rigidity of the base rail 120 is increased without a corresponding increase in an overall height 216 of the base rail 120. By limiting the overall height 216 of the base rail 120, the total height of the air handling unit 100 is also limited. A lower total height of the air handling unit 100 enables improved wind resistance of the air handling unit 100 when the air handling unit 100 is installed on the curb 104 and enables more manageable transportation and relocation of the air handling unit 100. Furthermore, the disclosed configuration of the base rail 120 provides increased stiffness and structural rigidity while also limiting or reducing an overall weight of the air handling unit 100. For example, the base rail 120 having the illustrated geometry may be more lightweight than a base rail having a traditional design or geometry and a similar stiffness.

Figure 7:
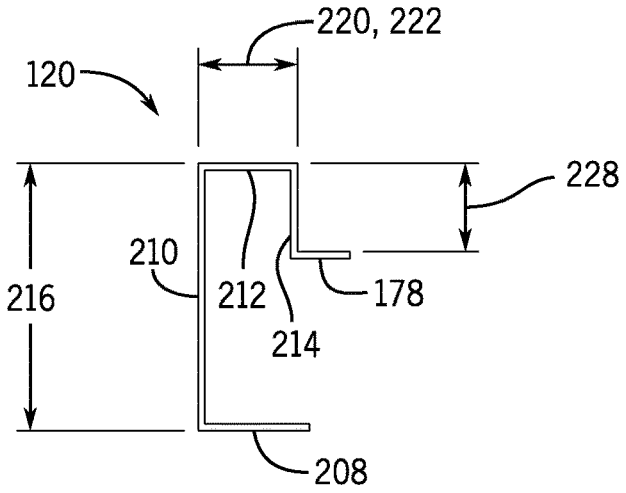
FIG. 7 is a cross-sectional axial view of an embodiment of a base rail of a base system for a housing of an HVAC system, in accordance with an aspect of the present disclosure.
Figure 8:
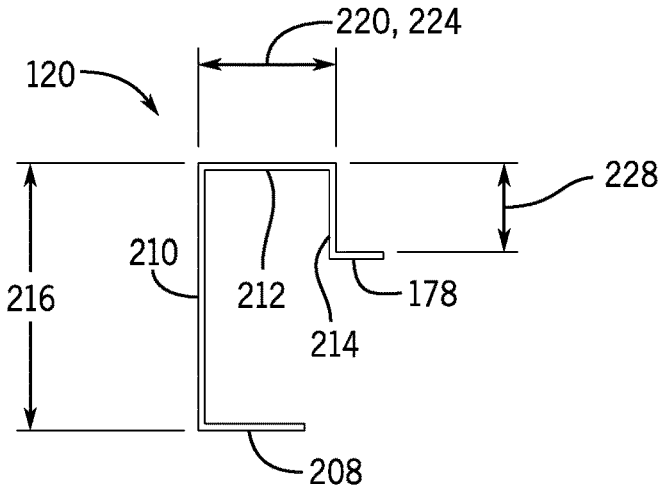
FIG. 8 is a cross-sectional axial view of an embodiment of a base rail of a base system for a housing of an HVAC system, in accordance with an aspect of the present disclosure.
Figure 9:
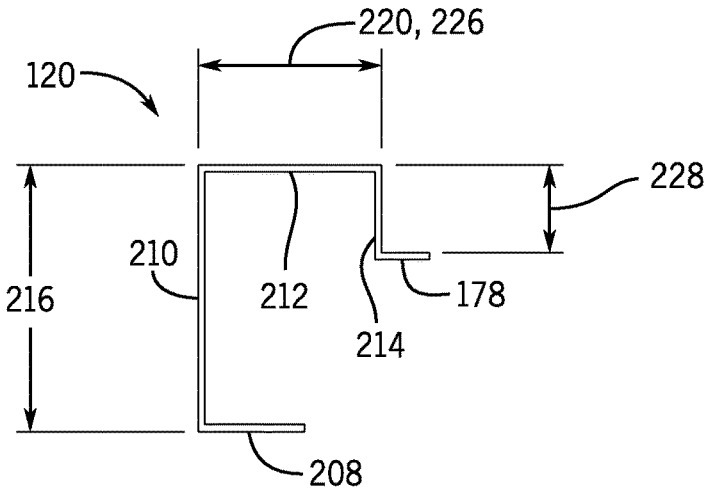
FIG. 9 is a cross-sectional axial view of an embodiment of a base rail of a base system for a housing of an HVAC system, in accordance with an aspect of the present disclosure.

Dimensions of the various segments or portions of the base rail 120 may be selected based on desired characteristics and/or operating parameters of the base system 114 and/or the air handling unit 100. For example, FIGS. 7-9 are cross-sectional axial views of the base rail 120, illustrating various dimensions of top portion 212 of the base rail 120. Specifically, FIG. 7 illustrates the top portion 212 having a width 220 with a first magnitude 222, FIG. 8 illustrates the top portion 212 having the width 220 with a second magnitude 224, and FIG. 9 illustrates the top portion 212 having the width 220 with a third magnitude 226. In some embodiments, the magnitude of the width 220 may be selected based on a desired stiffness or moment of inertia of the base rail 120, and the magnitude of the width 220 may be selected without affecting the overall height 216 of the base rail 120.

Other dimensions of the base rail 120 may be selected based on other desired characteristics of the air handling unit 100 and/or base system 114. For example, a height 228 of the internal wall 214 may be selected based on a desired or selected height of the floor panel 152. In some embodiments, the height 228 of the internal wall 214 is selected such that the floor panel 152 is substantially recessed within the base rail 120 (e.g., relative to a direction of gravity) in an assembled configuration of the base system 114. Thus, the floor panel 152, which may have a height or depth of approximately 2 inches, may be dropped within and secured to the base rail 120. Further, as the floor panel 152 does not extend between the base rail 120 and the wall panel 116, as in existing designs, the floor panel 152 may be removed and replaced within the base system 114 without disassembling other components (e.g., the wall panel 116) of the air handling unit 100, and the air handling unit 100 may provide improved thermal insulation.

Accordingly, embodiments of the present disclosure are directed to the base system 114 for the housing 102 of the air handling unit 100 or other HVAC system. The base system 114 includes the base rail 120 that provides desired structural rigidity for the air handling unit 100 and that may be manufactured and/or assembled more efficiently (e.g., faster, at reduced cost, etc.). For example, the base rail 120 has a geometry with an increased moment of inertia that provides improved rigidity and/or stiffness of the base system 114. Base system 114 configurations disclosed herein may also have reduced height dimensions (e.g., vertical dimensions) and/or reduced weights, as compared to traditional air handling unit bases or foundations. Further, the embodiments disclosed herein enable improvements in operational efficiency of the air handling unit 100, such as by providing improved thermal breaks or barriers between the internal volume 110 of the air handling unit 100 and the external environment 184 surrounding the air handling unit 100.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A base system for a heating, ventilation, and air conditioning (HVAC) system, comprising:

a frame configured to support a housing of the HVAC system, wherein the frame comprises a base rail configured to define a portion of a perimeter of the frame, wherein the base rail comprises a base segment having a base rail face configured to abut a curb in an installed configuration of the HVAC system, an external wall extending transversely from the base segment, a top segment extending transversely from the external wall and over the base segment, an internal wall extending transversely from the top segment toward the base segment, and a recessed flange extending from the internal wall and away from the external wall.

2. The base system of claim 1, wherein the external wall comprises a first dimension extending from the base segment to the top segment, the internal wall comprises a second dimension extending from the top segment to the recessed flange, and the second dimension is less than the first dimension.

3. The base system of claim 1, comprising a floor panel coupled to and supported by the base rail, wherein the floor panel is secured to the recessed flange.

4. The base system of claim 3, wherein the floor panel is secured to the recessed flange via an adhesive.

5. The base system of claim 3, wherein the floor panel comprises a base portion and a lip extending from the base portion, wherein the base portion extends along and is secured to the recessed flange, and the lip extends along the internal wall.

6. The base system of claim 5, comprising a gasket disposed between the floor panel and the base rail.

7. The base system of claim 6, wherein the gasket extends continuously between the recessed flange and the base portion and between the lip and the internal wall.

8. The base system of claim 3, wherein the base rail is a first base rail, the frame comprises a second base rail configured to define an additional portion of the perimeter of the frame, the floor panel is coupled to and supported by the second base rail, and the second base rail is disposed on a side of the frame opposite the first base rail relative to the floor panel.

9. The base system of claim 8, comprising an interior cross rail extending between and coupled to the first base rail and the second base rail, wherein the floor panel is coupled to and supported by the interior cross rail.

10. The base system of claim 1, wherein the external wall comprises a punched hole configured to receive a lifting device.

11. An enclosure for a heating, ventilation, and air conditioning (HVAC) system, comprising:

a frame comprising a plurality of base rails defining a perimeter of the enclosure, wherein a base rail of the plurality of base rails comprises a base segment configured to be disposed on a curb in an installed configuration of the enclosure, an external wall extending from the base segment, a top segment extending from the external wall and toward an interior of the enclosure, an internal wall extending from the top segment toward the base segment, and a recessed flange extending from the internal wall toward the interior of the enclosure; and a floor panel captured between the plurality of base rails, wherein the floor panel is disposed on and secured to the recessed flange of the base rail.

12. The enclosure of claim 11, wherein the floor panel is coupled to and supported by the base rail and an additional base rail of the plurality of base rails, wherein the floor panel extends from the base rail to the additional base rail.

13. The enclosure of claim 11, wherein the floor panel comprises a base portion and a plurality of lips extending from the base portion, wherein the base portion is disposed vertically below the top segment of the base rail relative to a direction of gravity.

14. The enclosure of claim 13, wherein a lip of the plurality of lips extends along the internal wall of the base rail.

15. The enclosure of claim 13, comprising a gasket disposed between the base rail and the floor panel, wherein the gasket extends between the recessed flange and the base portion and extends between the internal wall and a lip of the plurality of lips.

16. The enclosure of claim 15, comprising a wall panel disposed on the top segment of the base rail, wherein the wall panel comprises a mounting flange secured to the external wall of the base rail, and wherein the gasket extends between the top segment and the wall panel.

17. The enclosure of claim 11, wherein the floor panel is secured to the recessed flange via an adhesive.

18. The enclosure of claim 11, wherein each additional base rail of the plurality of base rails comprises an additional base segment configured to be disposed on the curb in the installed configuration of the enclosure, an additional external wall extending from the additional base segment, an additional top segment extending from the additional external wall toward the interior of the enclosure, an additional internal wall extending from the additional top segment, and an additional recessed flange extending from the additional internal wall toward the interior of the enclosure.

19. A heating, ventilation, and air conditioning (HVAC) system housing, comprising:

a plurality of base rails coupled to one another to define a base frame of the HVAC system housing, wherein a base rail of the plurality of base rails comprises:

a base segment configured to be disposed on a curb in an installed configuration of the HVAC system housing;

an external wall extending vertically from the base segment;

a top segment extending horizontally from the external wall and over the base segment;

an internal wall extending vertically from the top segment toward the base segment, and a recessed flange extending horizontally from the internal wall and away from the external wall.

20. The HVAC system housing of claim 19, comprising:

a plurality of wall panels coupled to the plurality of base rails to define an internal volume of the HVAC system housing; and a floor panel disposed entirely within the internal volume, wherein the floor panel comprises a base portion secured to the recessed flange of the base rail and a lip extending from the base portion and along the internal wall of the base rail.

* * * * *